US010565967B2

(12) United States Patent
Allen

(10) Patent No.: US 10,565,967 B2
(45) Date of Patent: Feb. 18, 2020

(54) MUSICAL ACCESSORY

(71) Applicant: Rheuben Alfred Allen, Torrance, CA (US)

(72) Inventor: Rheuben Alfred Allen, Torrance, CA (US)

( * ) Notice: Subject to any disclaimer, the term of this patent is extended or adjusted under 35 U.S.C. 154(b) by 0 days.

(21) Appl. No.: 16/380,599

(22) Filed: Apr. 10, 2019

(65) Prior Publication Data

US 2019/0311699 A1 Oct. 10, 2019

Related U.S. Application Data

(60) Provisional application No. 62/655,359, filed on Apr. 10, 2018.

(51) Int. Cl.
*G10D 9/00* (2020.01)
*G10D 7/08* (2006.01)

(52) U.S. Cl.
CPC ..... *G10D 9/005* (2013.01); *G10D 7/08* (2013.01)

(58) Field of Classification Search
CPC ..... G10D 9/005; G10D 7/08
See application file for complete search history.

(56) References Cited

U.S. PATENT DOCUMENTS 1,308,903 A * 7/1919 Gulick ..... G10D 9/005 84/386
1,555,986 A * 10/1925 Keefer, Jr. ..... G10D 9/005 84/396
1,652,306 A * 12/1927 Holton ..... G10D 9/005 84/396
1,759,824 A * 5/1930 Gulick ..... G10D 9/005 84/396
1,867,481 A * 7/1932 Todt ..... G10D 9/005 84/386
2,015,029 A * 9/1935 Bertrand ..... G10G 5/00 84/453
2,146,967 A * 2/1939 Loomis ..... G10D 9/005 84/394
2,738,696 A * 3/1956 Ritterbach ..... G10D 9/005 84/394
4,276,804 A * 7/1981 Holland ..... G10D 9/005 84/394
4,512,233 A * 4/1985 Holland ..... G10D 9/005 84/387 R
6,008,444 A * 12/1999 Chesko ..... G10D 9/04 84/388
6,664,456 B2 * 12/2003 Momchilovich ..... G10D 3/16 84/385 A
7,563,970 B2 * 7/2009 Laukat ..... G10D 7/005 84/380 R (Continued)

*Primary Examiner* — Robert W Horn

(57) ABSTRACT

A musical instrument accessory includes a base plate, two supports, a track, and multiple weights. The two supports connect the base plate to the neck of the musical instrument and the track is located on the base plate. The user may customize the musical instrument by putting one or more weights on appropriate positions on the track. This action modifies the weight distribution of the accessory, creates more vibrations, and modifies affect the tone color and response of the musical instrument in the meantime. With experimentation, everyone can create his or her own unique tone color and response by simply shifting one or more weights to different positions on the track.

19 Claims, 10 Drawing Sheets

(56) References Cited

U.S. PATENT DOCUMENTS

| | | | | |
|---|---|---|---|---|
| 10,013,958 | B2 * | 7/2018 | Satterlee | G10D 7/08 |
| 10,424,277 | B2 * | 9/2019 | Satterlee | G10D 9/00 |
| 2018/0293966 | A1 * | 10/2018 | Satterlee | G10D 9/043 |
| 2019/0311699 | A1 * | 10/2019 | Allen | G10D 9/00 |

* cited by examiner

MUSICAL ACCESSORY

The current application claims a priority to the U.S. Provisional Patent application Ser. No. 62/655,359 filed on Apr. 10, 2018.

FIELD OF THE INVENTION

The present invention is an instrument accessory. More specifically, the present invention is an accessory attaching to a saxophone and allowing the user to customize the tone of the saxophone by modifying the center of weight. The user may adjust the plurality of weights along the track on the present invention to achieve the most suitable result by experimenting with different vibration, response, or tone color.

BACKGROUND OF THE INVENTION

Music has been part of human life for thousands of years. Many different instruments were developed and customized. However, in the current industrial age, all saxophones are standardized and rarely left any room for customization. Nevertheless, standardization may limit music developments, since everyone in the musical art has different ways to interpret and create his/her own music. Therefore, any type of accessory that can create some customizations to saxophones can contribute as a good solution to this issue. Moreover, traditional saxophone neck brace also has the following issues:

1. Uses a large amount of solder to attach the brace to the neck.
2. Impairing the response, tone, and increasing resistance to the saxophone neck because the traditional brace is soldered over the original solder seam.
3. Traditional brace's design makes it easy to bend the neck during play or placing the mouthpiece on the neck of the saxophone.

The present invention provides a solution to the issue mentioned above. The present invention is a musical accessory configured to attached to the neck of the saxophone. The present invention has two supports to firmly attach the present invention to the instrument to achieve the best balance between the stability and vibration. The user can customize the saxophone by shifting the plurality of weights to different positions on the present invention. Different weights allow the user to find the most suitable vibration, response, and tone color through experimentation. Moreover, when comparing to the traditional neck brace, the present invention only requires two small solder on the neck, allowing the neck to vibrate better and provides better response. The two small solders also strengthen the neck and make it more difficult to bend the neck during play or placing the mouthpiece on the neck. Finally, the present invention can be added to any saxophone neck with or without the traditional brace.

DETAIL DESCRIPTIONS OF THE INVENTION

All illustrations of the drawings are for the purpose of describing selected versions of the present invention and are not intended to limit the scope of the present invention.

The present invention is an instrument accessory that allows the user to customize and configure the tone of the saxophone by first installed onto the neck of the saxophone. Then the user may put different weights along the track opening of the present invention. Different weights on different positions on the track opening modify the center of the weight of the saxophone and allow the user to customize the tone of the saxophone by experimenting with different amount of vibration and response.

Figure 1:
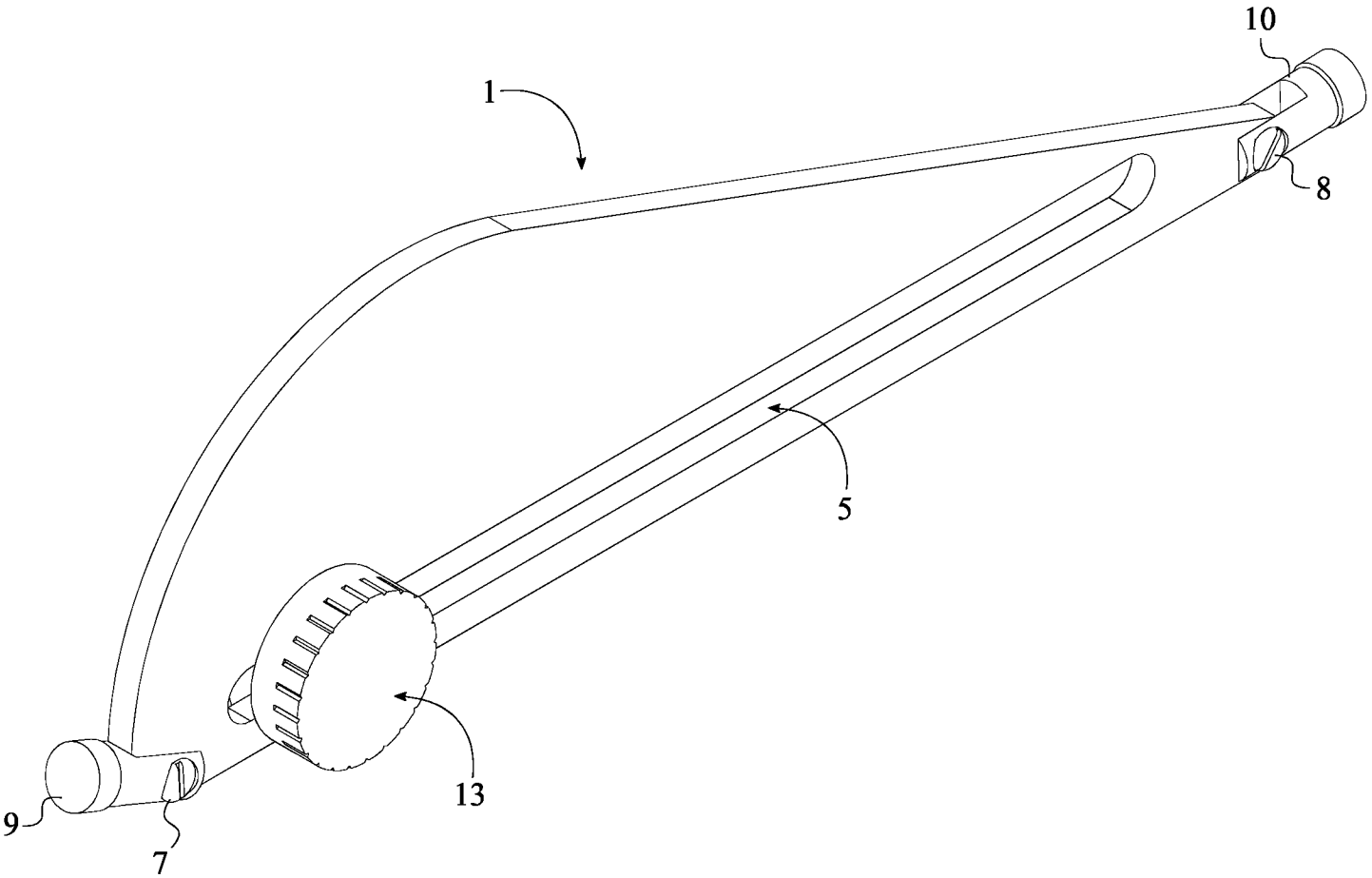
FIG. 1 is a perspective view of the present invention showing the female portion of the at least one weight.
Figure 2:
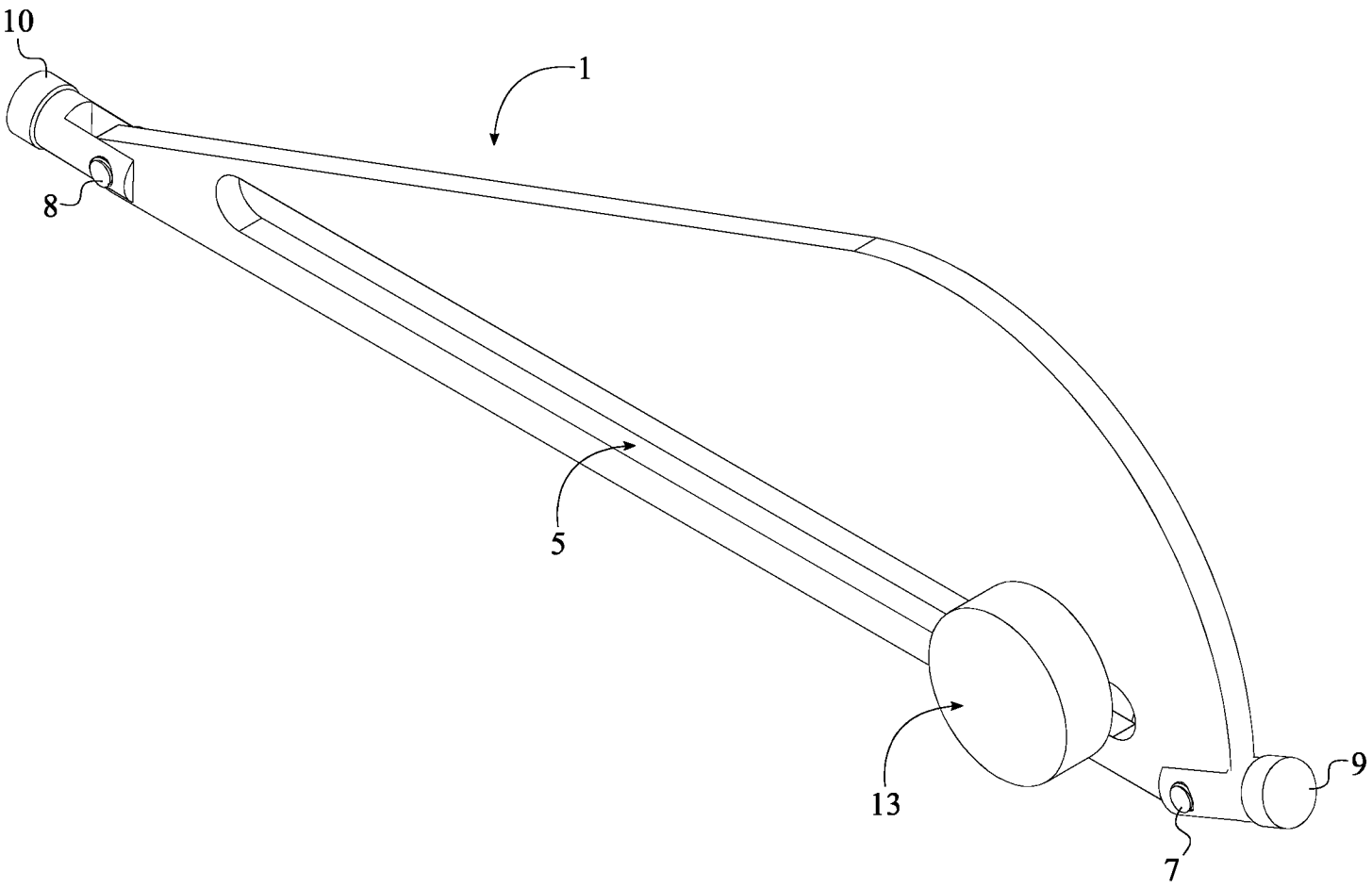
FIG. 2 is a perspective view of the present invention showing the male portion of the at least one weight.
Figure 3:
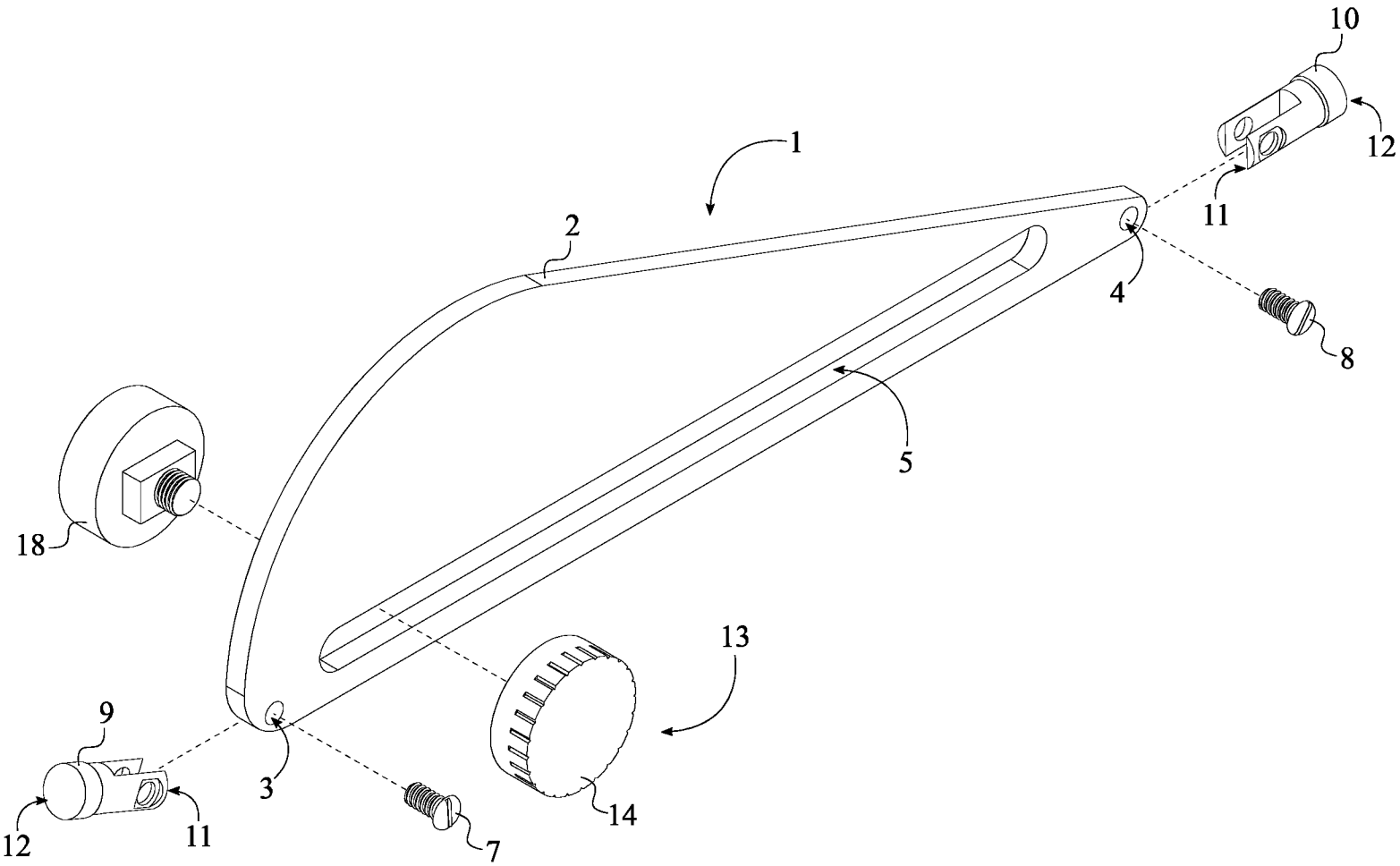
FIG. 3 is an exploded perspective view of the present invention, showing components and their connections.

In reference to FIG. 1-3, the present invention is an instrument accessory and comprises a base plate 1, a track 5, a first fastener 7, a second fastener 8, a first support 9, a second support 10, and at least one weight 13. The base plate 1 forms the main body of the present invention and is configured to serve as a base to hold or connect different components of the present invention. The first support 9 is terminally attached to the base plate 1 by the first fastener 7 and is configured to attach the base plate 1 to the instrument's neck. The second support 10 is terminally attached to the base plate 1 by the second fastener 8 and is configured to attach the base plate 1 to the instrument's neck. The first support 9 and the second support 10 are positioned opposite to each other about the track 5. This configuration provides the best configuration between stability and vibration. The user can customize the saxophone by putting the at least one weight 13 on the track 5 without worrying the present invention from falling off. The at least one weight 13 comprises a female portion 14 and a male portion 18. The female portion 14 and the male portion 18 may differ in weight and allows the user to customize the instrument according to different weight combinations and experimenting with different vibration, response, and tone color. The male portion 18 is slidably engaged to the track 5, and the female portion 14 is threadedly attached to the male portion 18. The user may adjust the position of the at least one weight 13 by moving the male portion 18 to different positions on the track 5. The user may customize the sound of the instrument by first attaching the male portion 18 onto the track 5, then attaching the female portion 14 to the male portion 18 so the at least one weight 13 can be locked on the appropriate position on the track 5. The user may remove the at least one weight 13 from the track 5 by separating the female portion 14 from the male portion 18, then removing the male portion 18 from the track 5.

Figure 4:
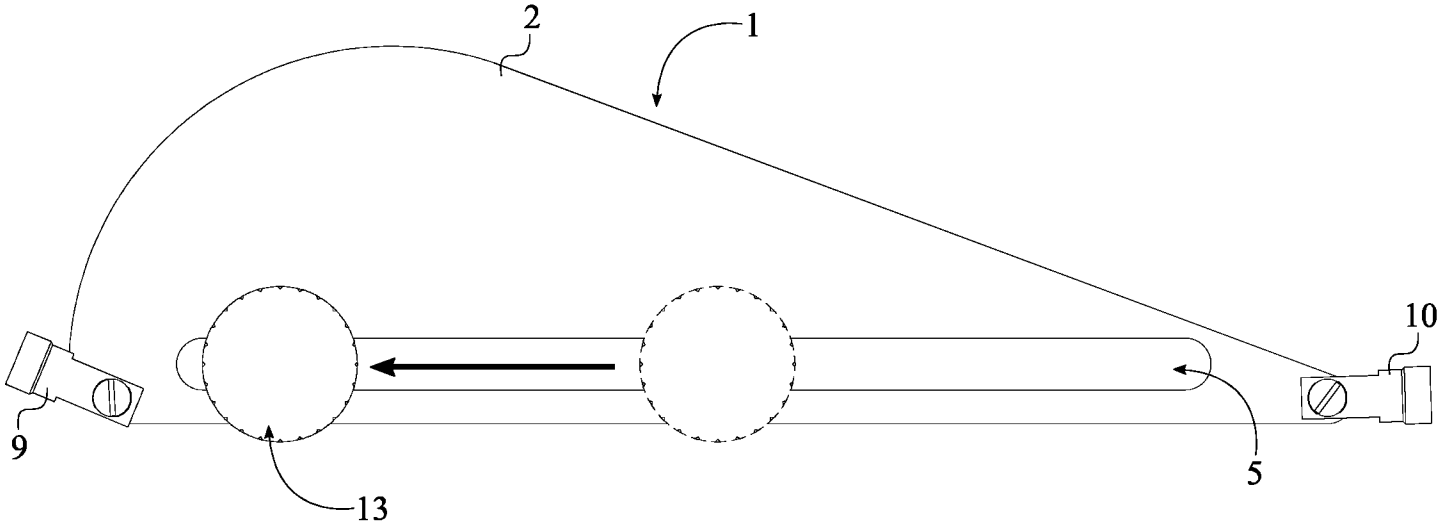
FIG. 4 is a side view of the present invention with the at least one weight in different position on the track, wherein the track is a linear track.

In reference to FIGS. 3 and 4, the base plate 1 comprises a plate body 2 and a first opening 3. The plate body 2 is configured to hold or connect all components of the present invention. The first support 9 comprises a first end 11 and a second end 12 and is configured to connect the plate body 2 to the neck of the instrument. The first opening 3 traverses through the plate body 2 and is configured to allow the first fastener 7 to attach the first support 9 to the plate body 2. The first end 11 is terminally attached to the first opening 3 by the first fastener 7. The first end 11 is a U-shaped section and sandwiched the plate body 2 in between the U-shaped section. The first fastener 7 locked the first end 11 to the plate body 2 by traversing through both the first end 11 and the plate body 2. The first fastener 7 is perpendicular to both the first end 11 and the plate body 2. In the preferred embodiment, the first fastener 7 is a screw. The second end 12 is adjacently connected to the first end 11. The user may attach or connect the second end 12 to an instrument, such as the neck of the saxophone. In the preferred embodiment, the second end 12 is soldered to the neck of the saxophone to reduce vibration, which may contribute unwanted noise.

In reference to FIG. 3, the base further comprises a second opening 4. The second support 10 comprises a first end 11 and a second end 12 and is configured to connect the plate body 2 to the neck of the instrument. The second opening 4 traverses through the plate body 2 and is configured to allow the second fastener 8 to attach the second support 10 to the plate body 2. The first end 11 is terminally attached to the second opening 4 by the second fastener 8. In the present embodiment, the first end 11 is a U-shaped section and sandwiched the plate body 2 in between the U-shaped section. The second fastener 8 locked the first end 11 to the plate body 2 by traversing through both the first end 11 and the plate body 2. The second fastener 8 is perpendicular to both the first end 11 and the plate body 2. In the preferred embodiment, the second fastener 8 is a screw. The second end 12 is adjacently connected to the first end 11. The user may attach or connect the second end 12 to an instrument, such as the neck of the saxophone. In the preferred embodiment, the second end 12 is soldered to the neck of the saxophone to reduce vibration, which may contribute unwanted noise.

Figure 5:
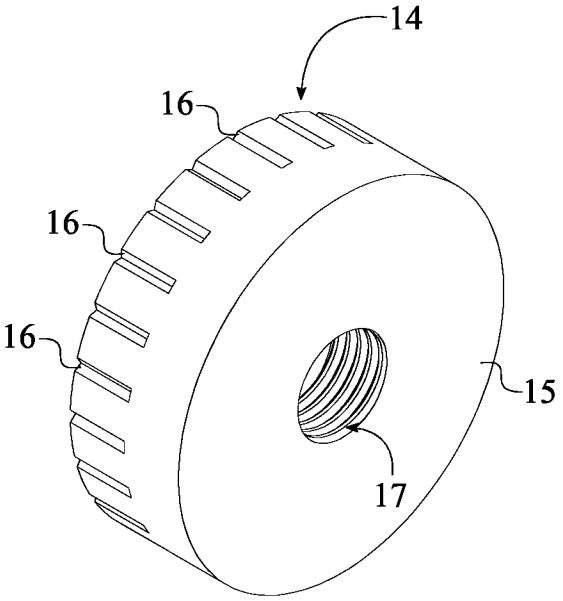
FIG. 5 is a perspective view of the female portion.

In reference to FIG. 5, the female portion 14 of the at least one weight 13 comprises a body 15, a plurality of grooves 16, and an opening 17. The plurality of grooves 16 is radially positioned on the body 15, which is configured to increase the friction to facilitate turning, when the user wishes to attach the female portion 14 to the male portion 18 by screwing them together, or the user may detach the female portion 14 from the male portion 18 by unscrewing and separate them. The opening 17 is concentrically positioned to the plurality of grooves and configured to allow the user to engage the male portion 18 into the female portion 14 through the opening 17. The opening 17 is concentrically traversing into the body 15. The user may introduce the male portion 18 into the female portion 14 via the opening 17 when the user needs to attach the male portion 18 to the female portion 14 and locks the at least one weight 13 on the appropriate position on the track 5. The body 15 of the female portion 14 is to provide an appropriate weight with the male portion 18 to make different vibration.

Figure 7:
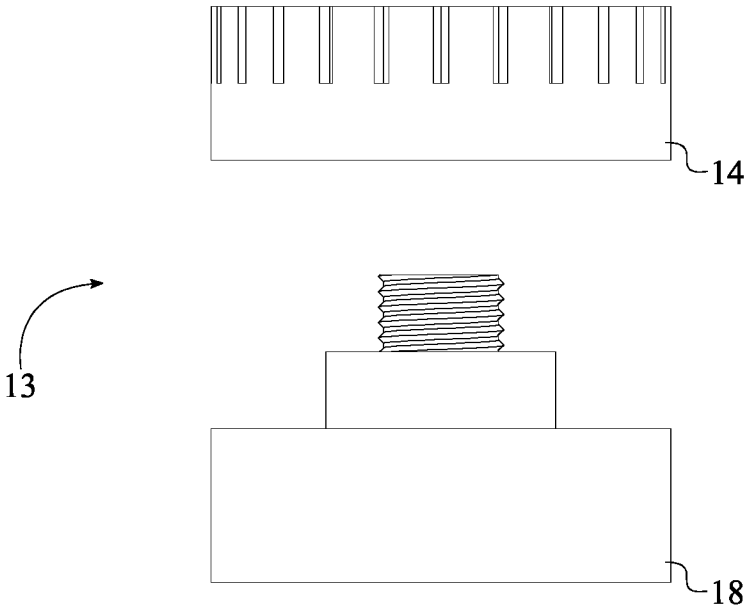
FIG. 7 is a side view of the lightest female portion with the male portion.
Figure 8:
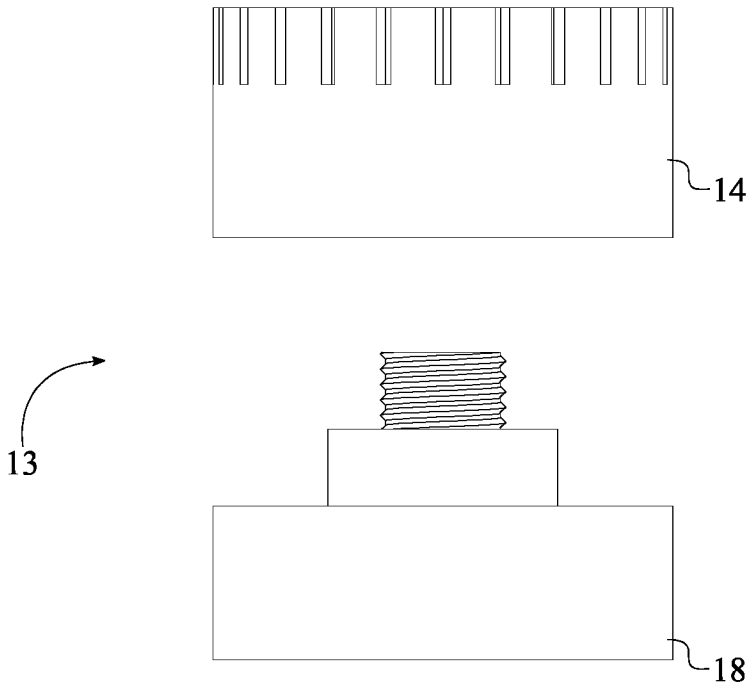
FIG. 8 is a side view of the medium female portion with the male portion.
Figure 9:
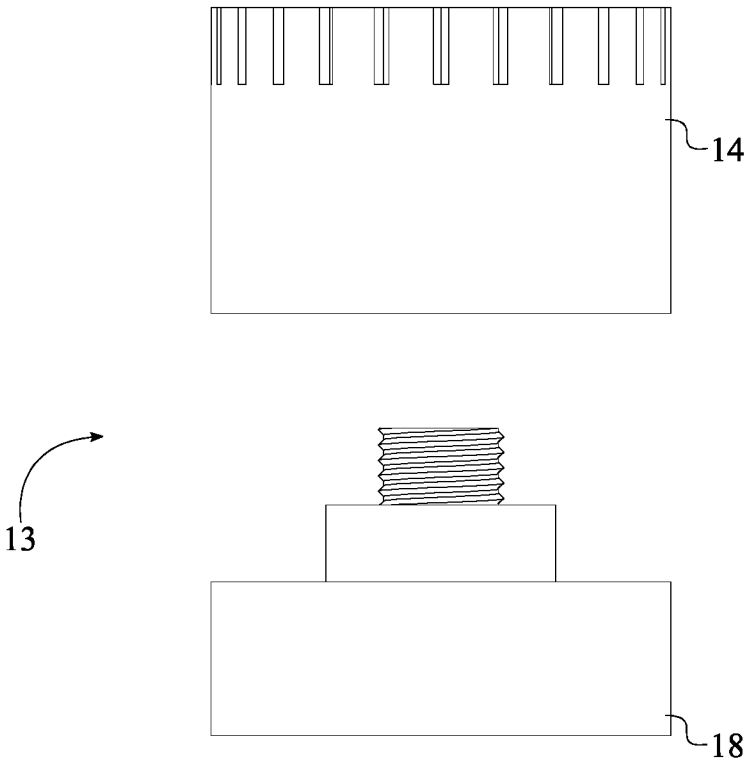
FIG. 9 is a side view of the heaviest female portion with the male portion.

In reference to FIG. 7-9, the female portion 14 of the at least one weight 13 can differ from one another within the present invention. More specifically, a first female portion 14 of the at least one weight 13 ranges from 0.5-1 ounces (oz) thus delineating the lowest weight. Preferably, the first female portion 14 is 18 millimeter (mm) in circumference and 7.75 mm in thickness. The second female portion 14 of the at least one weight 13 ranges from 1-2 oz and thus delineating the medium weight. Preferably, the second female portion 14 is also 18 mm in circumference and 11.75 mm in thickness. The third female portion 14 of the at least one weight 13 ranges from 1.5-2 oz thus delineating the heaviest weight. Preferably, the third female portion 14 is also 18 mm in circumference and 11.75 mm in thickness.

Figure 6:
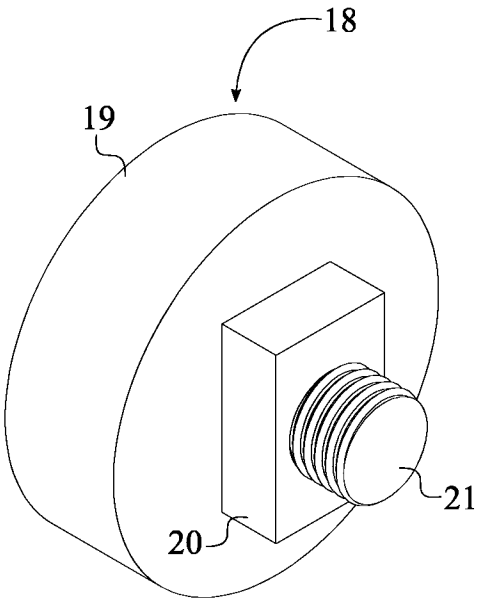
FIG. 6 is a perspective view of the male portion.

In reference to FIG. 6, the male portion 18 comprises a head 19, a shank 20, and a threaded section 21. The head 19, the shank 20, and the threaded section 21 are concentrically positioned with each other. The head 19 is adjacently connected to the shank 20 and is configured to provide an appropriate balanced weight with the female portion 14. The threaded section 21 is adjacently connected to the shank 20, opposite to the head 19. The threaded section 21 is configured to increase the friction to facilitate turning and engagement, when the user attaches the male portion 18 to the female portion 14 by screwing the male portion 18 into the opening 17 of female portion 14. The user can separate the male portion 18 from the female portion 14 by unscrewing the male portion 18 from the female portion 14. The shank 20 of the male portion 18 is slidably engaged with the track 5 and configured to fit the male portion 18 onto the track 5. In the preferred embodiment, the shank 20 is formed into a rectangular shape so that the shank 20 can slide within the track 5 without having to vertically move or vibrate.

In reference to FIG. 6, a preferred embodiment of the male portion 18 is consistent throughout the different female portion 14 of the at least one weight 13. Preferably, the head 19 has 18 mm in circumference with a rectangular shank 20. The length of the rectangular shank 20 is 11.12 mm and the width of the rectangular shank 20 is 5.95 mm.

The threaded section 21 of the male portion 18 is threadedly engaged with the opening 17 of the female portion 14. The user may attach the male portion 18 to the female portion 14 by introducing the threaded section 21 of the male portion 18 into the opening of the female portion 14, then screw the threaded section 21 into the opening 17. The track 5 is in linear shape and is configured to allow the user to place the at least one weight 13 on different locations on the track 5 according to the user's preference. In the preferred embodiment, the threads on the threaded section 21 are 5.25 mm long.

Figure 10:
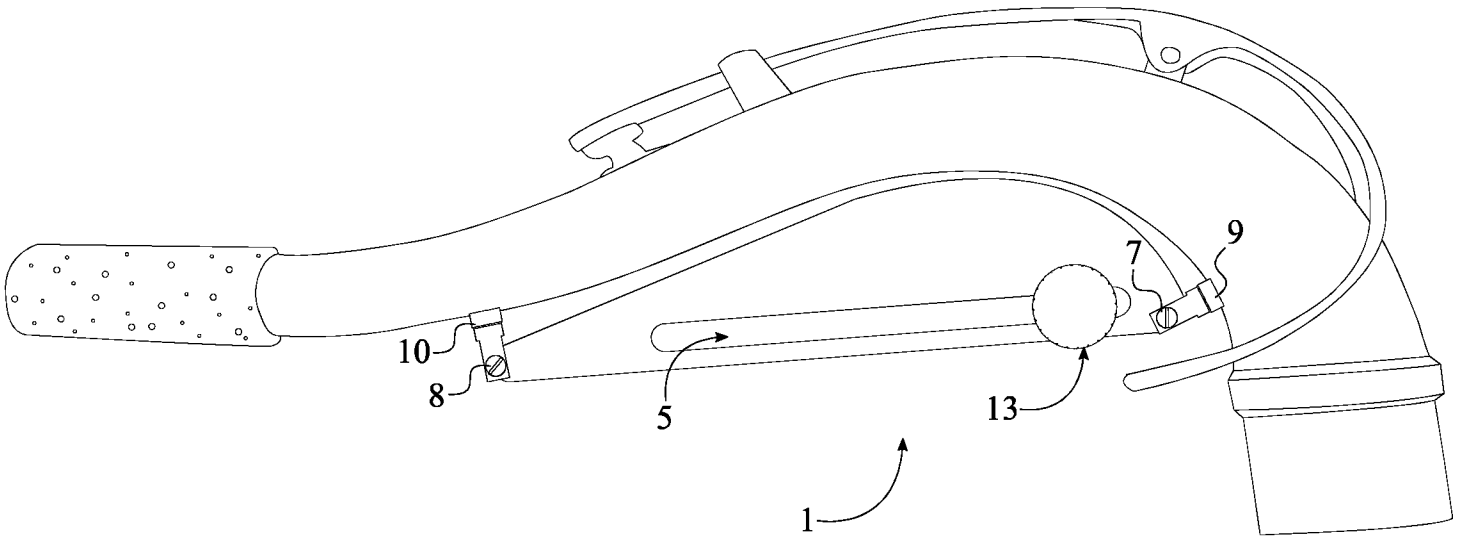
FIG. 10 is a side view of the present invention attached to the neck of a saxophone.

The user may use the present invention in the following manner: first, install the present invention to the instrument's neck by connecting the second end 12 of the first support 9 and the second end 12 of the second support 10 to the instrument's neck. Then attach the first end 11 of the first support 9 to the base plate 1 with the first fastener 7 and attach the first end 11 of the second support 10 to the base plate 1 by the second fastener 8. Finally, the user can install the at least one weight 13 to the track 5 by placing the shank 20 of the male portion 18 on the appropriate position on the track 5, then lock the weight in place by introduce the threaded section 21 of the male portion 18 into the opening 17 of the female portion 14. In the preferred embodiment, the present invention is soldered to the saxophone's neck, with or without the traditional neck brace. In reference to FIG. 10, since the present invention only has two small solder spots, it is a stronger design than the traditional neck brace and makes it more difficult for the user to bend the neck. While the preferred embodiment of the present invention is attaching to the neck of the saxophone, the user may attach the present invention on other musical instruments as well.

Although the invention has been explained in relation to its preferred embodiment, it is to be understood that many other possible modifications and variations can be made without departing from the spirit and scope of the invention as hereinafter claimed.

What is claimed is:

1. An instrument accessory comprises:
a base plate;
a track;
a first fastener;
a second fastener;
a first support;
a second support;
at least one weight;
the at least one weight comprises a female portion and a male portion;
the track traversing through the base plate;
the first support being terminally attached to the base plate by the first fastener;
the second support being terminally attached to the base plate by the second fastener;
the first support and the second support being oppositely positioned of each other about the track;
the male portion being slidably engaged to the track; and
the female portion being threadedly attached to the male portion.

2. The instrument accessory as claimed in claim 1 comprises:
the base plate comprises a plate body and a first opening;
the first support comprises a first end and a second end;
the first opening traversing through the plate body;
the first end being terminally attached to the first opening by the first fastener; and
the second end being adjacently connected to the first end, opposite to the first opening, wherein the second end is connected to a saxophone neck.

3. The instrument accessory as claimed in claim 1 comprise:
the base plate comprises a plate body and a second opening;
the second support comprises a first end and a second end;
the second opening traversing through the plate body;
the first end being terminally attached to the second opening by the second fastener; and
the second end being adjacently connected to the first end, opposite to the second opening, wherein the second end is connected to a saxophone neck.

4. The instrument accessory as claimed in claim 1 comprises:
the female portion comprises a body, a plurality of grooves, and an opening;
the plurality of grooves being radially positioned on the body;
the opening being concentrically positioned to the plurality of grooves; and
the opening concentrically traversing into the body.

5. The instrument accessory as claimed in claim 1 comprises:
the male portion comprises a head, a shank, and a threaded section;
the head, the shank, and the threaded section being concentrically positioned with each other;
the head being adjacently connected to the shank; and
the threaded section being adjacently connected to the shank, opposite to the head.

6. The instrument accessory as claimed in claim 1, wherein a shank of the male portion slidably engaged with the track.

7. The instrument accessory as claimed in claim 1, wherein a threaded section of the male portion threadedly engaged with an opening of the female portion.

8. The track as claimed in claim 1, wherein the track is a linear track.

9. An instrument accessory comprises:
a base plate;
a track;
a first fastener;
a second fastener;
a first support;
a second support;
at least one weight;
the at least one weight comprises a female portion and a male portion;
the track traversing through the base plate;
the first support being terminally attached to the base plate by the first fastener;
the second support being terminally attached to the base plate by the second fastener;
the first support and the second support being oppositely positioned of each other about the track;
the male portion being slidably engaged to the track;
the female portion being threadedly attached to the male portion;
the female portion comprises a body, a plurality of grooves, and an opening;
the plurality of grooves being radially positioned on the body;
the opening being concentrically positioned to the plurality of grooves;
the opening concentrically traversing into the body;
the male portion comprises a head, a shank, and a threaded section;
the head, the shank, and the threaded section being concentrically positioned with each other;
the head being adjacently connected to the shank; and
the threaded section being adjacently connected to the shank, opposite to the head.

10. The instrument accessory as claimed in claim 9 comprises:
the base plate comprises a plate body and a first opening;
the first support comprises a first end and a second end;
the first opening traversing through the plate body;
the first end being terminally attached to the first opening by the first fastener; and
the second end being adjacently connected to the first end, opposite to the first opening, wherein the second end is connected to a saxophone neck.

11. The instrument accessory as claimed in claim 9 comprise:
the base plate comprises a plate body and a second opening;
the second support comprises a first end and a second end;
the second opening traversing through the plate body;
the first end being terminally attached to the second opening by the second fastener; and
the second end being adjacently connected to the first end, opposite to the second opening, wherein the second end is connected to a saxophone neck.

12. The instrument accessory as claimed in claim 9, wherein a shank of the male portion slidably engaged with the track.

13. The instrument accessory as claimed in claim 9, wherein a threaded section of the male portion threadedly engaged with an opening of the female portion.

14. The track as claimed in claim 9, wherein the track is a linear track.

15. An instrument accessory comprises:
a base plate;

a track;
a first fastener;
a second fastener;
a first support;
a second support;
at least one weight;
the at least one weight comprises a female portion and a male portion;
the track traversing through the base plate;
the first support being terminally attached to the base plate by the first fastener;
the second support being terminally attached to the base plate by the second fastener;
the first support and the second support being oppositely positioned of each other about the track;
the male portion being slidably engaged to the track;
the female portion being threadedly attached to the male portion;
the female portion comprises a body, a plurality of grooves, and an opening;
the plurality of grooves being radially positioned on the body;
the opening being concentrically positioned to the plurality of grooves;
the opening concentrically traversing into the body;
the male portion comprises a head, a shank, and a threaded section;
the head, the shank, and the threaded section being concentrically positioned with each other;
the head being adjacently connected to the shank;
the threaded section being adjacently connected to the shank, opposite to the head; and
the instrument accessory as claimed in claim 9, wherein a shank of the male portion slidably engaged with the track.

16. The instrument accessory as claimed in claim 15 comprises:
the base plate comprises a plate body and a first opening;
the first support comprises a first end and a second end;
the first opening traversing through the plate body;
the first end being terminally attached to the first opening by the first fastener; and
the second end being adjacently connected to the first end, opposite to the first opening, wherein the second end is connected to a saxophone neck.

17. The instrument accessory as claimed in claim 15 comprise:
the base plate comprises a plate body and a second opening;
the second support comprises a first end and a second end;
the second opening traversing through the plate body;
the first end being terminally attached to the second opening by the second fastener; and
the second end being adjacently connected to the first end, opposite to the second opening, wherein the second end is connected to a saxophone neck.

18. The instrument accessory as claimed in claim 15, wherein a threaded section of the male portion threadedly engaged with an opening of the female portion.

19. The track as claimed in claim 15, wherein the track is a linear track.

* * * * *